US008899454B2

(12) United States Patent
Mainetti

(10) Patent No.: US 8,899,454 B2
(45) Date of Patent: Dec. 2, 2014

(54) HANGER WITH FOLDABLE/REMOVABLE HOOK

(71) Applicant: Mainetti S.p.A, Castelgomberto (IT)

(72) Inventor: Mario Mainetti, Valdagno (IT)

(73) Assignee: Mainetti S.p.A, Castelgomberto (Vicenza) (IT)

( * ) Notice: Subject to any disclaimer, the term of this patent is extended or adjusted under 35 U.S.C. 154(b) by 0 days.

(21) Appl. No.: 14/108,621

(22) Filed: Dec. 17, 2013

(65) Prior Publication Data

US 2014/0252048 A1 Sep. 11, 2014

(30) Foreign Application Priority Data

Mar. 7, 2013 (IT) ..... VI2013A0059

(51) Int. Cl.
*A41D 27/22* (2006.01)
*A47G 25/40* (2006.01)
*A47G 25/32* (2006.01)

(52) U.S. Cl.
CPC ..... *A47G 25/40* (2013.01); *A47G 25/32* (2013.01)
USPC ..... 223/85; 223/94

(58) Field of Classification Search
CPC ..... A47G 25/32; A47G 25/325; A47G 25/38; A47G 25/40
USPC ..... 223/85, 88, 89, 92, 94, DIG. 4
See application file for complete search history.

(56) References Cited

U.S. PATENT DOCUMENTS

| | | | | |
|---|---|---|---|---|
| 2,428,820 | A | 10/1947 | Therrien | |
| 3,726,452 | A | 4/1973 | Jaffe | |
| 4,063,670 | A | 12/1977 | Faarbech | |
| 4,487,343 | A | 12/1984 | Chen | |
| 5,183,190 | A * | 2/1993 | Zuckerman | 223/DIG. 4 |
| 5,826,759 | A * | 10/1998 | Ohsugi | 223/85 |
| 8,381,952 | B2 * | 2/2013 | Mainetti | 223/85 |
| 2009/0283556 | A1 * | 11/2009 | Ho | 223/85 |
| 2011/0073624 | A1 | 3/2011 | Blanchard | |
| 2012/0104056 | A1 * | 5/2012 | Mainetti | 223/85 |
| 2012/0241481 | A1 * | 9/2012 | Merandi | 223/85 |

FOREIGN PATENT DOCUMENTS

| | | |
|---|---|---|
| DE | 85 36 129.1 | 2/1986 |
| FR | 2 599 612 | 12/1987 |
| GB | 2 355 922 | 5/2001 |
| JP | 52-6493 | 1/1977 |

OTHER PUBLICATIONS

Italian Search Report and Written Opinion dated Oct. 23, 2013 from corresponding Italian Application No. VI20130059.

* cited by examiner

*Primary Examiner* — Nathan Durham
(74) *Attorney, Agent, or Firm* — Katten Muchin Rosenman LLP

(57) ABSTRACT

Disclosed herein is a hanger with a foldable/removable hook, of the type that is made up of an arched body and a projecting crook-shaped hook, provided with a base, which allows the removably hooking of said hook on said body, as well as a rotation thereof, with reference to the position of normal use thereof, from vertical to horizontal and vice versa, i.e. from perpendicular to parallel with respect to the arched body. In addition, when said hook is raised, so as to allow the hanger to assume a normal configuration, it has the same mechanical resistance of a common hanger with fixed hook.

8 Claims, 4 Drawing Sheets

HANGER WITH FOLDABLE/REMOVABLE HOOK

FIELD OF THE INVENTION

The present invention is directed to a hanger with foldable/removable hook.

BACKGROUND OF THE INVENTION

As well known, a common hanger is made up of an arched body, centrally provided with a projecting crook-shaped hook. The hook is constituted by a wire-like body, generally made of steel, that engages in a stable manner, with the lower part thereof, in the arched body, usually made of plastic material.

Hangers are usually used several times, hence once they are free of the hanged garment, they are kept away, until next use. The drawback that is observed during the step of storing hangers in stores lies in the overall dimensions of the single hanger, defined by the width-wise dimension of the arched body and from the extension of the projection of the hook from the top part of the arched body. Furthermore the projection of the hook from the arched body constitutes a considerable overall dimension even when the hanger is packaged in a container with the garment hanged.

Practically, the overall dimension of the hanger, especially depending on the extension of the hook, thus becomes a major and crucial parameter in each step of utilisation of the hanger itself: from the manufacturer of the hangers, where there is required the maximum reduction possible of the dimensions of the packagings used for the shipment of the hangers to the garment makers, to the sales facility, when the hanger should be handled with the garment hanged, in particular, through the delivery sales channels, where the overall dimensions of the container of the folded hanged garment provided with hanger determine the dimension of the container to be shipped, which have an impact on the costs of transport, up to the so-called "recycling" operation, when the hanger, from a sales point where it is no longer used, is shipped again to the tailoring stores for the reutilization thereof.

In the current state of the art there are known hangers which can reduce the overall dimensions thereof providing for that the hook is held on the arched body through a connection which allows the disengagement and a rotation thereof, when required, so as to be moved into the space defined by the arched body itself.

By way of example reference is made to patent document VI2010A000293 in which there is described a hanger with foldable hook, which is characterized in that the base of the hook, at a side thereof, is connected to the arched body through a flexible tab, which allows the aforementioned hook an elastic twisting, in particular a 90° rotation and beyond, from vertical to horizontal and vice versa, i.e. from perpendicular to parallel on the arched body; vice versa on the opposite side said base is provided with an hook which holds, during the operating step, the hook on the arched body so that, when the hook is raised, the hanger takes up the configuration typical of the normal function thereof, having the same resistance of a common hanger with fixed hook.

Disadvantageously, the aforementioned hanger, as well as other hangers which provide for the movement of the hook to reduce the overall dimension thereof, (by way of example reference shall be made to those described in patent documents U.S. Pat. No. 3,726,452, U.S. Pat. No. 4,487,343, U.S. Pat. No. 2,428,820, U.S. Pat. No. 4,063,670 and GB 2355922) are obtained through a structural technique which is rather complex and which requires considerably modifying the design both of the arched body and the lower end of the hook, with considerable moulding costs.

In particular, in the hangers where the hook is held on the arched body through a flexible tab there is required the use of a plastic material with considerable elastic properties, such as polypropylene, which has a higher cost of raw material with respect to a less expensive plastic material, such as polystyrene, which however has a limited degree of elasticity.

In addition, in the structural solutions known up to date, due to the mobility of the connection between the hook and arched body, during use the hanger does not have a sufficiently rigid structure, like the one observed in a common monoblock hanger, which, practically, determines a considerable difficulty of optimally holding the hanged garment, sometimes causing even the aforementioned to fall.

Document FR 2 599 612 A1, which constitutes the most important document of the state of the art, provides a hanger in which the hook and the arched body constitute two separate components, which are mutually held by introducing the base of the hook in a cavity obtained on the central upper part of the aforementioned arched body, which has a particular design of the two opposite parts which determine a rapid operation of hooking/unhooking, which ensures a rigid structure (hook/arched body) during use and allow the hook, remaining constrained to the arched body, to rotate up to 90°, so as to reduce the overall dimension of the hanger, when it is not in use.

SUMMARY OF THE INVENTION

Structurally, the base of the hook provides for a ratchet, where there is introduced the end of the hook, to which there are associated two longitudinal walls, arranged opposite and mutually spaced, by a value equivalent to the thickness of the central portion of the arched body engaged in the hook, when said base is applied on said portion. Between the two walls there are introduced two pins, arranged transverse and symmetric with respect to the axis of the hook, which, upon engagement, end up introduced in corresponding hollows, open at the upper part, obtained on the aforementioned portion of the arched body.

An object of the present finding is that of providing a hanger which when not hanged, requires a minimum overall dimension and which is without the drawbacks shown by similar products of the known type.

Specifically, an object of the finding is that the making of the hanger is considerably simplified with respect to the structural techniques used for obtaining the hangers of the type similar to the one described above.

Still specifically, an object of the finding is that the making of a hanger as described above in which the manual handling of the hook is even simpler and quicker.

IN addition, an object of the finding is that the making of a hanger, as described above, does not considerably diverge from the design of a normal hanger with fixed hook, so that for the manufacture thereof there can be used the usual moulding equipment, which is just slightly modified, to the advantage of the cost of the moulding equipment and, thus, the end costs of the single product.

Still specifically, an object of the finding is the making of a hanger as described above, wherein, when the hook is extended in an operating position, said hook forms a rigid structure with the arched body.

Finally, an object of the finding is the making of a hanger as described above which allows the hook to be detached from the arched body in a single and quick manner.

This is obtained, according to the finding, by providing for that in one of the hollows present in the previously described device, there is present an elastic element, which deforms during the introduction of the pin in said hollow and, subsequently, with the elastic return, serves as a stop ratchet which prevents the pin form inadvertently slipping off from the hollow itself.

BRIEF DESCRIPTION OF THE DRAWINGS

The finding will be better described through the description of a possible embodiment thereof, provided solely by way of non-limiting example with reference to the attached drawings, wherein.

DETAILED DESCRIPTION OF THE INVENTION

Figure 2:
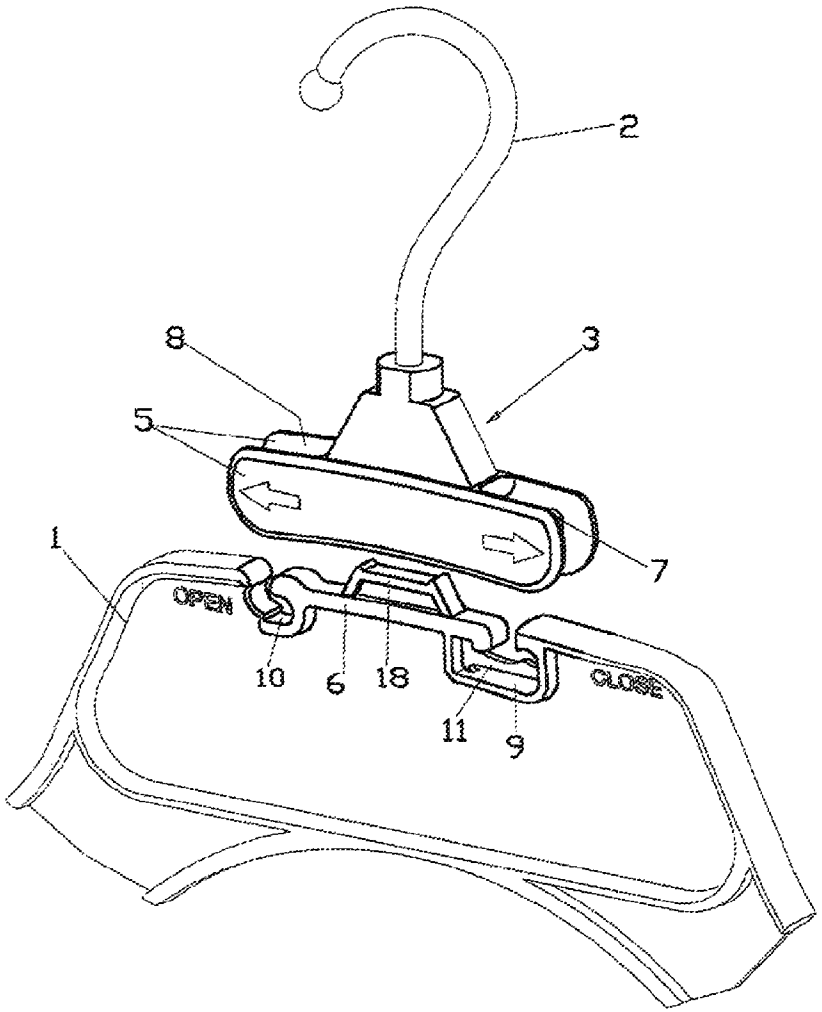
FIGS. 1 and 2 represent two perspective views of the hanger according to the finding, respectively in operating conditions and exploded view.
Figure 1:
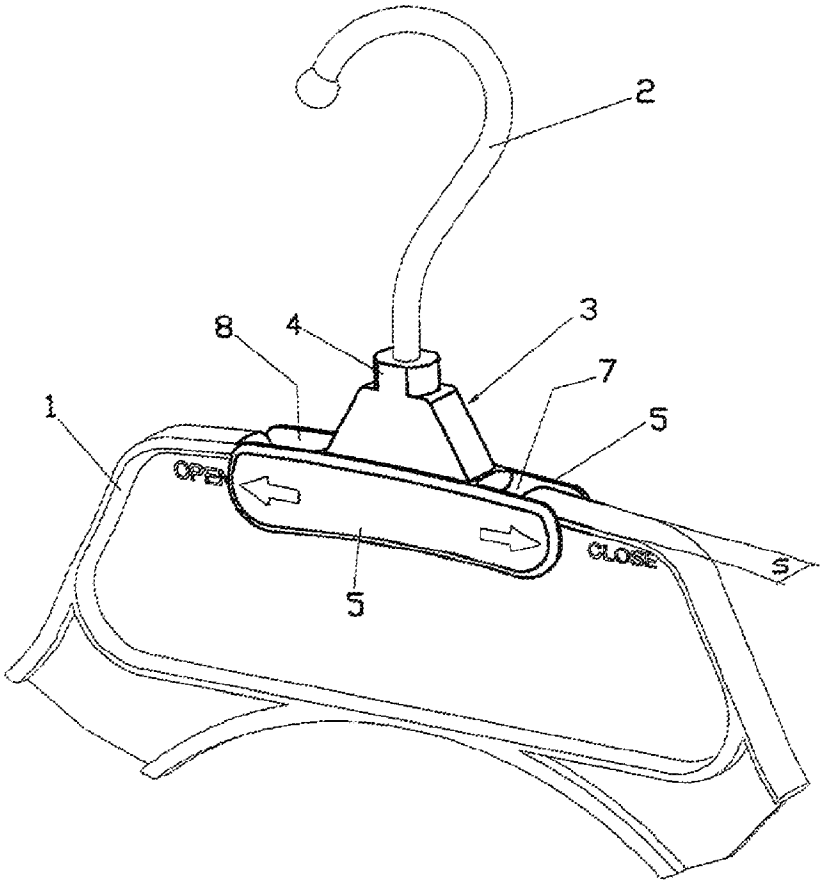

As observable in FIGS. 1-2, the hanger of the type constituted by an arched body 1 and by an hook 2 provided with a base 3, which allows the removably engaging of said hook 2 on said arched body 1, said hanger providing for that in the base 3 of the hook 2 the ratchet 4, where there is introduced the end of the hook, holds two longitudinal walls 5, which are opposite and mutually spaced by a value equivalent to the thickness "s" of the central portion 6 of the arched body 1, which is used in the engagement.

Between the two opposite walls 5 there are introduced two pins 7 and 8, arranged transverse and symmetric with respect to the axis of the hook 2 which, upon the engagement, end up introduced and are held in corresponding hollows 9 and 10, open at the upper part, obtained on the aforementioned portion 6 of the arched body.

In one of the two hollows 9 there is present an elastic tab 11, which deforms during the introduction of the pin 7 into said hollow 9 (see FIG. 4) and, subsequently, with the elastic return, it holds it, preventing it from slipping off inadvertently (see FIG. 5).

Figure 6:
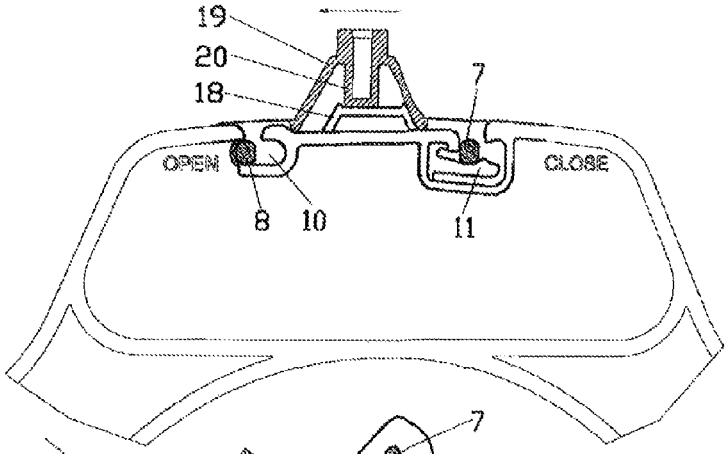
FIGS. 6-8 represent views, in front elevational and sectional view, of the rotation steps of the hook.
Figure 7:
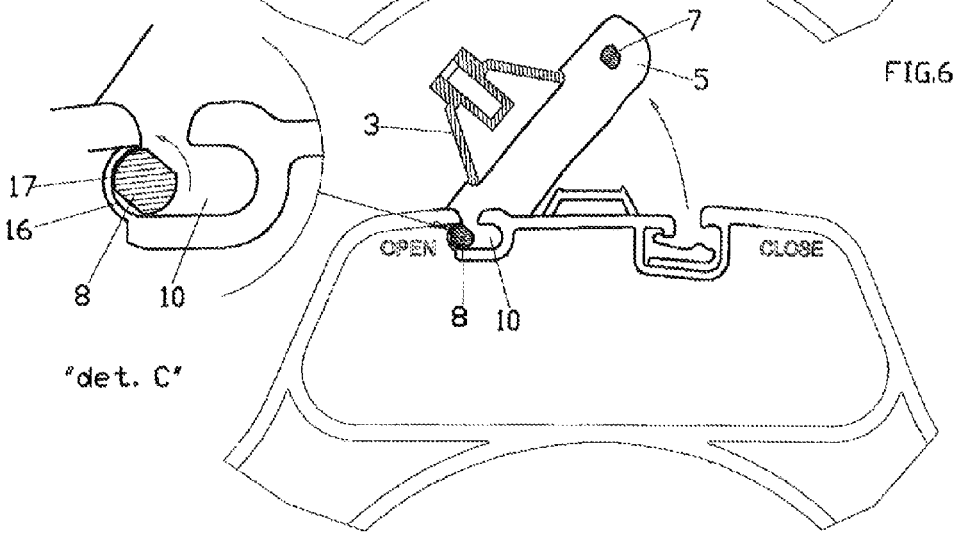
Figure 8:
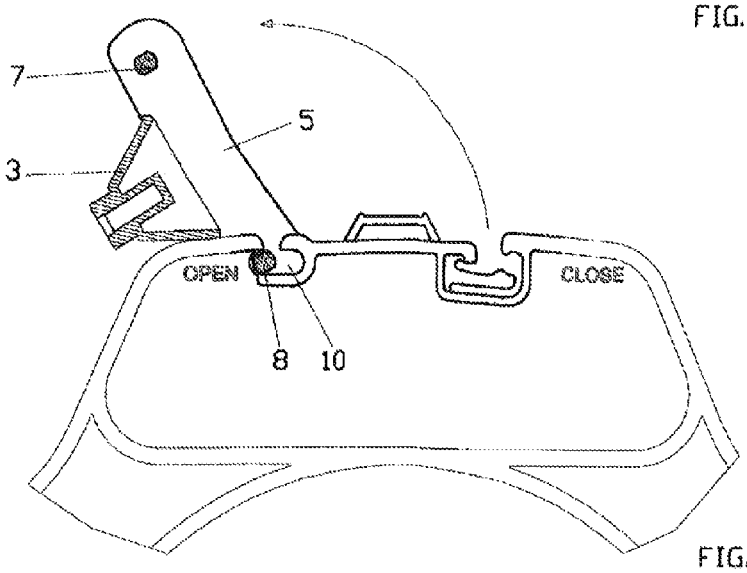
Figure 9:
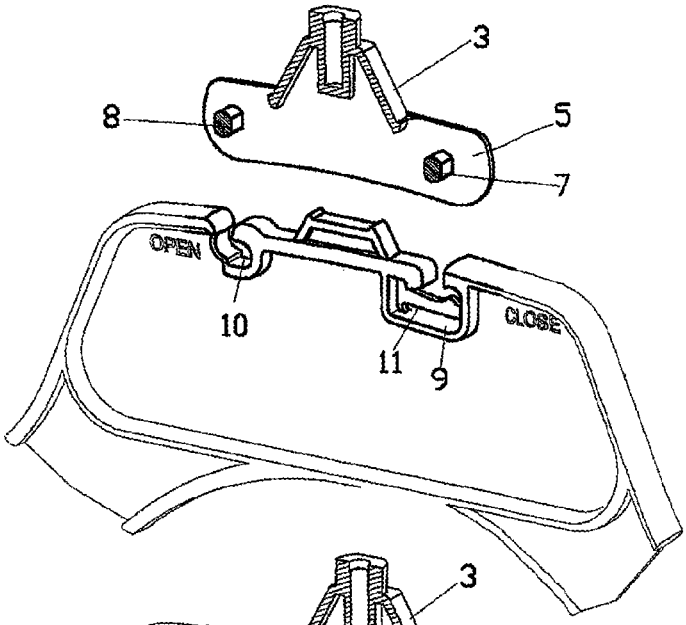
FIGS. 9-11 represent perspective views of the hanger in three different positions of the hook, respectively, detached, engaged to the body and folded.
Figure 10:
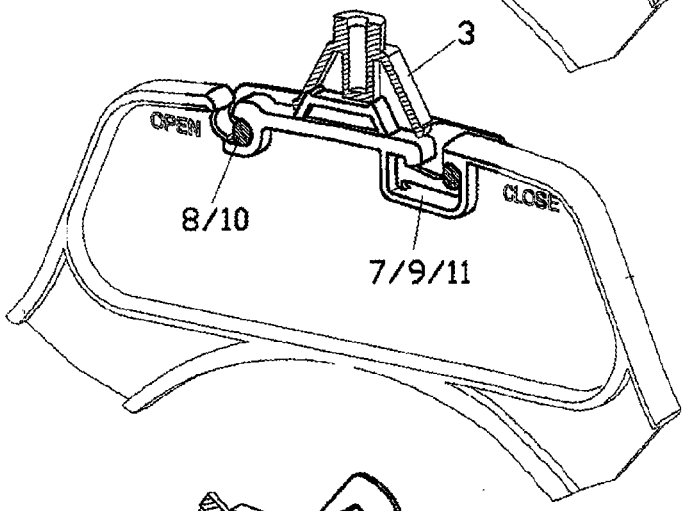
Figure 11:
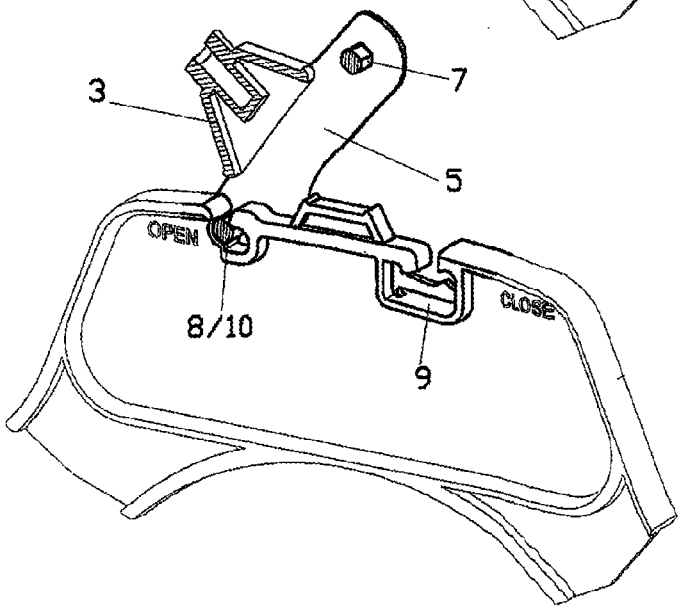

The other hollow 10 has a "lozenge-like" shape, which allows the other pin 8 a linear sliding (see FIGS. 5-6) and an angular rotation (see FIGS. 7-8).

Figure 3:
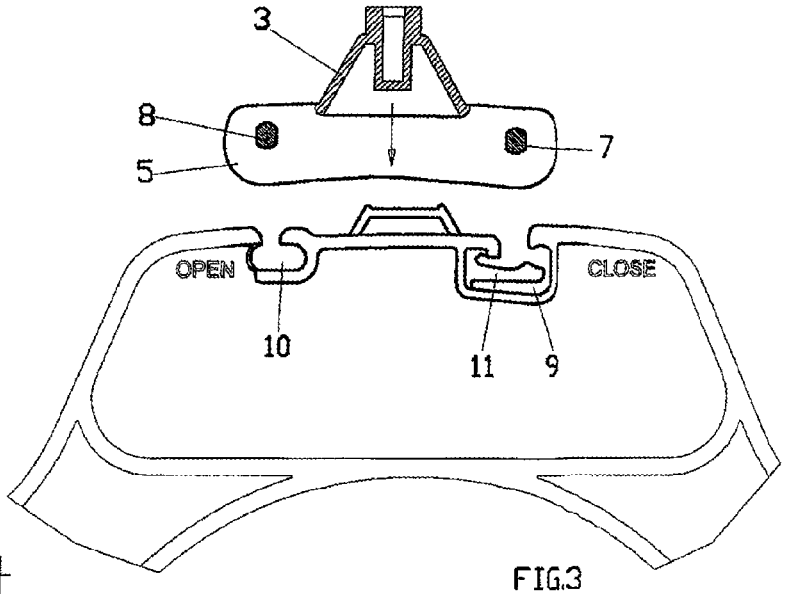
FIGS. 3-5 represent views, in elevational and sectional view, of the hooking steps of the hook base on the arched body.
Figure 4:
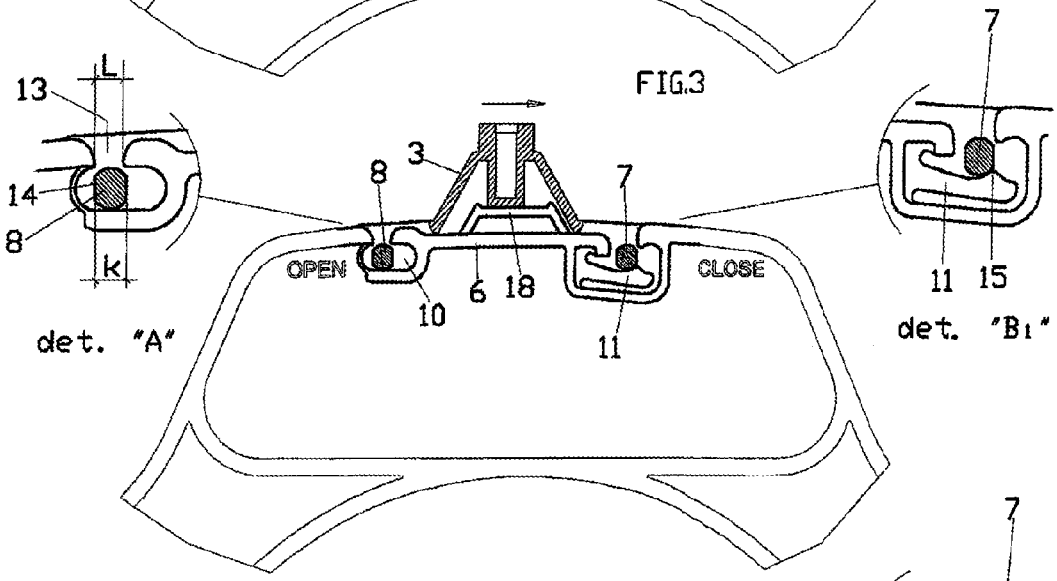
Figure 5:
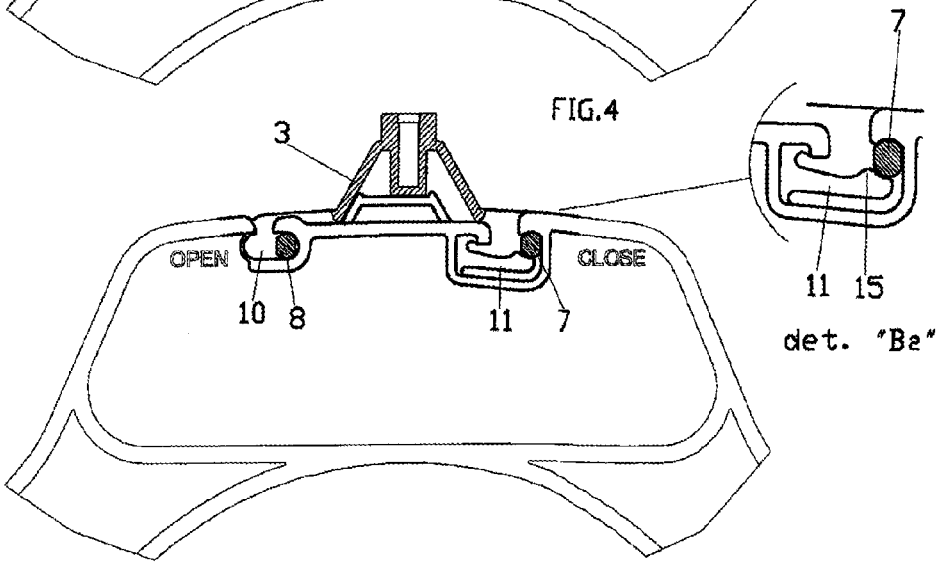

In use, as observable in the sequence of FIGS. 3-5, with the lowering of the base 3, the pins 7 and 8, pass through the corresponding openings 12 and 13 so as to be positioned in the underlying hollows 9 and 10.

In particular, as observable in detail "A" of FIG. 4, the opening 13 has a width "L" slightly greater with respect to the thickness "k" determined by the mutual distance of the two tapered walls 14 of the pin 8, so as to require a "forced engagement", which prevents said pin from inadvertently slipping from said engagement.

Still in particular, the elastic tab 11 is provided with a boss 15 which has two functions:

supporting the pin 7 to facilitate the deformation of the elastic tab 11 during the step of vertical introduction and lateral sliding of the base 3 (detail "$B_1$" of FIG. 4);

stably holding the pin 7 in place during the engagement (detail "$B_2$" of FIG. 5).

Still in use, as observable in the sequence of FIGS. 6-8, with the linear longitudinal sliding of the base 3 the pin 7 is again positioned at the opening 12 (see FIG. 6), so as to allow the manual rotation of the hook, which is guided by the rotation of the pin 8 in the hollow 10 (see FIGS. 7-8).

In particular, as observable in detail "C" of FIG. 7, the end surface 16 of the lozenge-shaped hollow 10 has a circular design, with radius equivalent to the radius of curvature 17 of the pin 8 and this allows facilitating the rotation of the aforementioned pin which slides at contact with said surface.

Lastly, in order to obtain maximum stability between the two elements, such to make the hanger according to the finding a monoblock, between the arched body 1 and the hook 2, there is provided a coupling through a shaped relief 18, projecting from the upper part 6 of the aforementioned body and the base 3; in particular, the cap 19 of the base and the lower end 20 of the ratchet 4 are engaged and are held on the aforementioned relief 18.

The finding thus designed can be susceptible to variants and modifications and the details thereof may be replaced by technically equivalent elements, as long as they fall within the scope of the inventive concept defined by the claims that follow.

The invention claimed is:

1. A hanger with a foldable/removable hook comprising:

an arched body (1); and a projecting crook-shaped hook (2), provided with a base (3), which allows the removably hooking of said hook (2) on said body (1), as well as a rotation thereof with reference to the position of normal use thereof, from vertical to horizontal and vice versa, and when said hook is raised, so as to allow the hanger to assume a normal configuration, it has the same mechanical resistance of a common hanger with fixed hook, there being provided for that in the base (3) of the hook (2) the ratchet (4), in which there is introduced the end of the hook, holds two longitudinal walls (5), which are opposite and mutually spaced by a value equivalent to the thickness (s) of the central portion (6) of the arched body (1), which is used in the hooking, between the two opposite walls (5) there being introduced two pins (7,8), arranged transverse and symmetric with respect to the axis of the hook (2), said pins (7,8), upon engagement, ending up being introduced and being held in corresponding hollows (9,10), open at the upper part, obtained on the aforementioned portion (6) of the arched body, in one of said hollows (9) there being present an element which serves as a ratchet for stopping the pin (7) in the seat during the use of the hanger, the other hollow (10) being shaped so as to hold the other pin (8) contained therein, during the rotation step of the hook, the hanger being characterised in that the element which holds the pin (7) in the hollow (9) is constituted by an elastic tab (11), which deforms during the introduction of the pin (7) into said hollows (9) and, subsequently, with the elastic return, holds said pin (7), preventing it from slipping off inadvertently.

2. The hanger according to claim 1, the elastic tab (11) is provided with a boss (15), which has two functions: supporting the pin (7) to facilitate the deformation of the elastic tab, during the vertical introduction step and linear sliding of the base (3) and stably holding the pin (7) in place during the hooking.

3. The hanger according to claim 1, wherein the hollow (10) has a lozenge-like shape, which allows the pin (8) a linear sliding and an angular rotation.

4. The hanger according to claim 3, wherein the end surface (16) of the lozenge-like hollow (10) has a circular shape, with radius equivalent to the radius of curvature (17) of the pin (8), for facilitating the rotation of the aforementioned pin which slides at contact with said surface.

5. The hanger according to claim 1, wherein the pins (7,8) are positioned in the corresponding hollows (9,10), through corresponding openings (12, 13), the opening (13) having a width (L) slightly greater with respect to the thickness (k) of the pin (8), so as to require a forced engagement, which prevents an inadvertent slipping off of said pin from said engagement.

6. The hanger according to claim 1, wherein, at least the pin (8), positioned in the rotation hollow (10), has two parallel tapered walls (14).

7. The hanger according to claim 1, wherein, in order to make the hanger a monoblock, there is provided for a coupling between the arched body (1) and the base (3) through a shaped relief (18), projecting from the upper part (6) of the aforementioned body.

8. The hanger according to claim 1, wherein the cap (19) of the base (3) and the lower end (20) of the ratchet (4) are mutually engaged and held on the shaped relief (18).

* * * * *